US008499948B2

(12) United States Patent
Chen

(10) Patent No.: US 8,499,948 B2
(45) Date of Patent: Aug. 6, 2013

(54) SUCTION TYPE BOTTLE CAP

(75) Inventor: Yuxiang Chen, Zhaodong (CN)

(73) Assignees: Zhiqiu Chen, Shenzhen (CN); Yuxiang Chen, Heilongjiang (CN); Weibing Sun, Heilongjiang (CN)

( * ) Notice: Subject to any disclaimer, the term of this patent is extended or adjusted under 35 U.S.C. 154(b) by 0 days.

(21) Appl. No.: 13/141,929

(22) PCT Filed: Dec. 24, 2009

(86) PCT No.: PCT/CN2009/076010
§ 371 (c)(1),
(2), (4) Date: Jun. 23, 2011

(87) PCT Pub. No.: WO2010/072167
PCT Pub. Date: Jul. 1, 2010

(65) Prior Publication Data

US 2011/0253665 A1 Oct. 20, 2011

(30) Foreign Application Priority Data

Dec. 24, 2008 (CN) ..... 2008 2 0211785 U
Aug. 21, 2009 (CN) ..... 2009 2 0308478 U

(51) Int. Cl.
*B65D 51/16* (2006.01)

(52) U.S. Cl.
USPC ..... 215/228; 215/316; 220/203.19; 220/212

(58) Field of Classification Search
USPC ..... 220/203.19, 212, 233, 239, 284, 220/254.7, 254.1, 278, 277, 203.01, 202, 220/200, 203.04, 203.07, 367.1; 215/316, 215/228, 307, 311, 364, 200; 222/153.1; 141/65, 330
IPC ..... B65D 51/16,53/00
See application file for complete search history.

(56) References Cited

U.S. PATENT DOCUMENTS 686,642 A * 11/1901 Wayte ..... 215/247

(Continued)

FOREIGN PATENT DOCUMENTS

CN 2132712 5/1993
CN 2171563 7/1994

(Continued)

OTHER PUBLICATIONS

International Search Report from PCT/CN2009/076010, dated Feb. 25, 2010, 5 pages.

*Primary Examiner* — Robert J Hicks
(74) *Attorney, Agent, or Firm* — IPro, Inc.; Na Xu

(57) ABSTRACT

A suction type bottle cap has a bottle cap and a suction device. The suction device comprises a vacuum draw bar, a liquid suction cavity, a piston and at least one suction pipe (5). The liquid suction cavity is connected with the bottle cap, the upper end of the suction pipe communicates with the liquid suction cavity, the lower end of the vacuum draw bar is placed in the liquid suction cavity, and the piston is arranged at the lower end of the vacuum draw bar. The suction type bottle cap can prevent liquid from polluting the bottle mouth so as to avoid unnecessary waste, is convenient for liquid suction and accurate in measurement, and is suitable for the suction of various liquids.

19 Claims, 11 Drawing Sheets

U.S. PATENT DOCUMENTS

| | | | | | |
|---|---|---|---|---|---|
| 1,356,224 | A | * | 10/1920 | Sager | 215/45 |
| 2,236,960 | A | * | 4/1941 | Salmond et al. | 222/541.8 |
| 4,524,877 | A | * | 6/1985 | Saxby et al. | 215/228 |
| 4,838,324 | A | * | 6/1989 | Boyd | 141/64 |
| 5,010,928 | A | * | 4/1991 | Ballas | 141/64 |
| 5,390,809 | A | * | 2/1995 | Lin | 220/212 |
| 6,637,321 | B2 | * | 10/2003 | Wang | 99/472 |

FOREIGN PATENT DOCUMENTS

| | | |
|---|---|---|
| CN | 201161770 | 12/2008 |
| CN | 201313681 | 9/2009 |
| EP | 1308400 | 2/2006 |
| JP | 2004269041 | 9/2004 |

* cited by examiner

SUCTION TYPE BOTTLE CAP

RELATED APPLICATION

The present application is the U.S. National Phase Application of International Application No. PCT/CN2009/076010, filed 24 Dec. 2009, which claims priority to Chinese Patent Application No. 200820211785.7, filed 24 Dec. 2008, and Chinese Patent Application No. 200920308478.5, filed 21 Aug. 2009, the entire contents of all of which are hereby incorporated by reference.

TECHNICAL FIELD

The invention relates to a bottle cap.

BACKGROUND ART

In order to take out the liquid in current liquid-accommodating bottles, the liquid could flow from the inner side to the outer side of bottle mouth to pollute bottle nozzle or flow to the outer wall of the bottle when the liquid in the bottle is poured and the bottle is placed vertically after the liquid is poured, thereby causing unnecessary waste and pollution, and this situation gets worse if the viscosity of the liquid is larger. For example: edible oil, shampoo, soy sauce, vinegar, detergent and the like, one drop at least or multiple drops of them at most flow out of the bottle mouth when the liquid in the bottle is poured and the bottle is placed vertically after the liquid is poured. In addition, as the bottle for accommodating liquid has no scale mark, the manufacturers that produce the above liquids fail to introduce the usage amounts of the liquid under different circumstances to consumers through convenient and definite measurement scale values so as not to give consumers the usage guidance, and the pouring amount is usually determined according to individual experience during pouring, so inaccurate pouring amount is caused. And in case of excessive pouring, the liquid cannot be returned.

SUMMARY OF INVENTION

The objective of the invention is to provide a suction type bottle cap for preventing liquid from polluting bottle mouth and being wasted and conveniently measuring, in order to solve the problem of the prior bottle that when the liquid in the bottle is poured and the bottle is placed vertically after the liquid is poured on condition that the liquid in the bottle needs to be poured, usually, the liquid could flow from the inner side to the outer side of the bottle mouth to pollute a bottle nozzle or flow to the outer wall of the bottle, thereby causing unnecessary waste and pollution, as well as the problems that manufacturer that produces the liquid fails to introduce reasonable usage amount of the liquid to consumers since no scale is marked on the current liquid-accommodating bottle, so the pouring amount of the liquid can only be determined according to individual experience and inaccurate pouring amount is caused, and that the liquid cannot be returned in case of excessive pouring.

In order to solve the above technical problems, the invention adopts three technical proposals below:

Technical proposal I: the suction type bottle cap in this proposal comprises a bottle cap (1), the sidewall of an inner cavity of the bottle cap (1) is provided with an internal thread connected with a bottle mouth; the suction type bottle cap is characterized in that: the suction type bottle cap further comprises a suction device; the suction device comprises a vacuum draw bar (2), a liquid suction cavity (3), a piston (4) and at least one suction pipe (5); the liquid suction cavity (3) is connected with the bottle cap (1), the upper end of the suction pipe (5) is communicated with the liquid suction cavity (3), the lower end of the vacuum draw bar (2) is mounted in the liquid suction cavity (3) and the lower end of the vacuum draw bar (2) is equipped with the piston (4).

Technical proposal II: on the basis of the technical proposal I, the inner wall or the outer wall of the liquid suction cavity 3 is provided with a scale mark. And with such an arrangement, the measurement for the sucked liquid is facilitated.

Technical proposal III: on the basis of the technical proposal I or II, the number of the suction pipe is 1 to 4, the suction pipe mouth is a plane or a slope, and the suction pipe 5 is straight or curved. And with such an arrangement, faster suction and discharging can be obtained when a plurality of suction pipes 5, instead of one suction pipe 5, are adopted. When a plurality of suction pipes 5 are arranged, the suction pipes 5 may be arranged on the same plane as the suction pipe month 5-1, but should be arranged to form a slope with respect to the suction pipe month 5-1 as much as possible, so that, when the bottle body is sloped to suck the liquid, a plurality of suction pipe months come into parallel contact with the wall of the bottle and are all submerged in the liquid as much as possible, not in the air above the liquid, therefore, the possibility of air suction is reduced.

The invention has the following advantages: 1. after the suction type bottle cap of the invention is used, the liquid flows inside the bottle body and comes into no contact with the bottle mouth so as not to further flow out of the bottle mouth, therefore, the liquid does not remain at the outer side of the bottle mouth or trickle onto the outer wall of the bottle. The suction pipes coming into contact with the liquid are arranged inside the bottle and are used for sucking and discharging the liquid. The suction pipes, when not needed, stay inside the bottle and, when needed to discharge the liquid, are arranged above a vessel that will accommodate the liquid, as a result, waste and pollution owing to the outward dripping of the liquid can be avoided. 2. Since the liquid suction cavity is arranged in the invention, the liquid which is sucked excessively can be returned in time. 3. Since the inner wall or the outer wall of the liquid suction cavity is provided with the scale mark, the manufacturer that produces the liquid can introduce reasonable usage amount of the liquid to consumers conveniently, and consumers are able to use liquid in the usage amount recommended by the liquid manufacturer. 4. The use of the suction type bottle cap of the invention can avoid inconvenient movement resulting from too heavy and large bottle, and the liquid in the bottle only needs to be sucked into the liquid suction cavity of the suction type bottle cap of the invention and then discharged to a required position. 5. Since the suction pipes arranged in the suction type bottle cap of the invention lead to stable flow rate of the liquid under particular pressure, the liquid can be uniformly discharged to the required position. 6. Using the suction type bottle cap of the invention, the liquid in accurate amount can be sucked out by means of suction and is then discharged by means of pressure, and this manner saves time dramatically compared with the manner that, in order to avoid too large flow rate, undetermined amount of the liquid trickles out of the bottle just by means of the gravity of the liquid; the suction pipes stay inside the bottle after being used, so no time is applied to waiting for the dropping of the liquid that is adhered to the suction pipes, thereby saving time. 7. When the suction type bottle cap of the invention is used, the liquid can be accurately discharged to a special position based on the advantage that the suction pipes are thin and long; and the majority of the bottles is hardly filled with liquid, so the suction type bottle cap of the invention can be utilized to fill in liquid when needed. 8. The suction type bottle cap of the invention can be commercially available with liquid products, so that the liquid in the commercially available liquid products can be sucked using the suction type bottle cap of the invention subsequent to the removal of traditional bottle cap; and the suction type bottle cap of the invention can also be commercially available independently, and is used when needed. And according to the viscosity of the liquid, the suction pipes can be designed in such a manner that the thickness thereof is not favorable for the dropping of the liquid. 9. The suction pipes can be used for stirring the liquid near the bottle mouth so as to uniformize the liquid better or check the presence of precipitates or impurities. 10. A part of liquid can be sucked out of the bottle to the liquid suction cavity, which facilitates observation in short distance. 11. The suction type bottle cap can server as a blender which blends the liquid in the bottle with the liquid in other bottles. In conclusion, the suction type bottle cap during the suction of liquid achieves the advantage of being more convenient, accurate, clean, time-saving, fast, light, liquid-saving and applicable, and is suitable for the suction of various liquids.

DETAILED DESCRIPTION OF EMBODIMENTS

Embodiment 1

Figure 1:
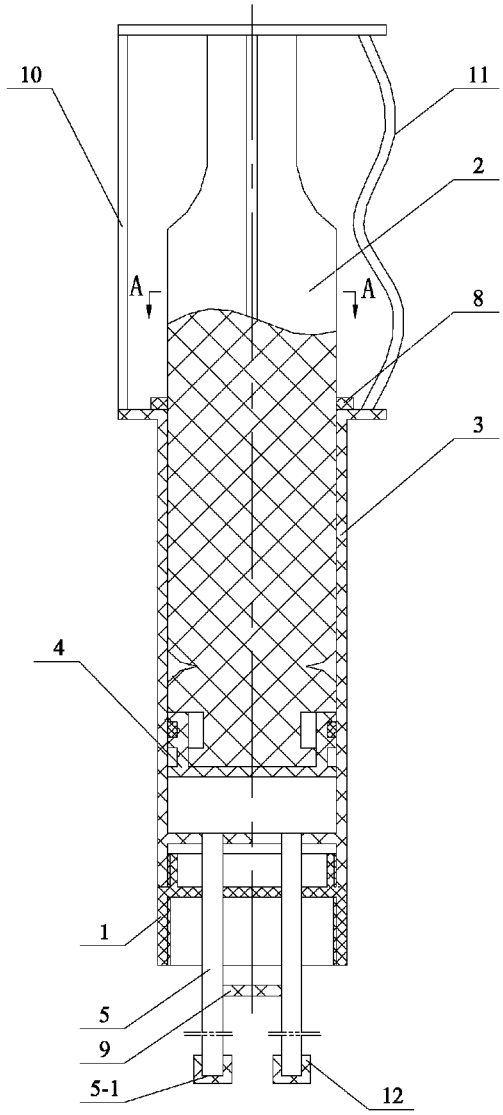
FIG. 1 is a schematic diagram of the entire structure of the invention (the suction pipe mouth 5-1 is a plane, spacing is formed between two adjacent suction pipes 5, the liquid suction cavity 3 and the bottle cap 1 are split in two parts and are connected with each other in the manner of the threaded fastener, and the vacuum draw bar 2 is a straight bar)
Figure 2:
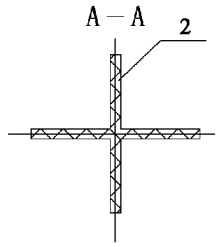
FIG. 2 is an A-A sectional view (cross-shaped) of FIG. 1.
Figure 3:
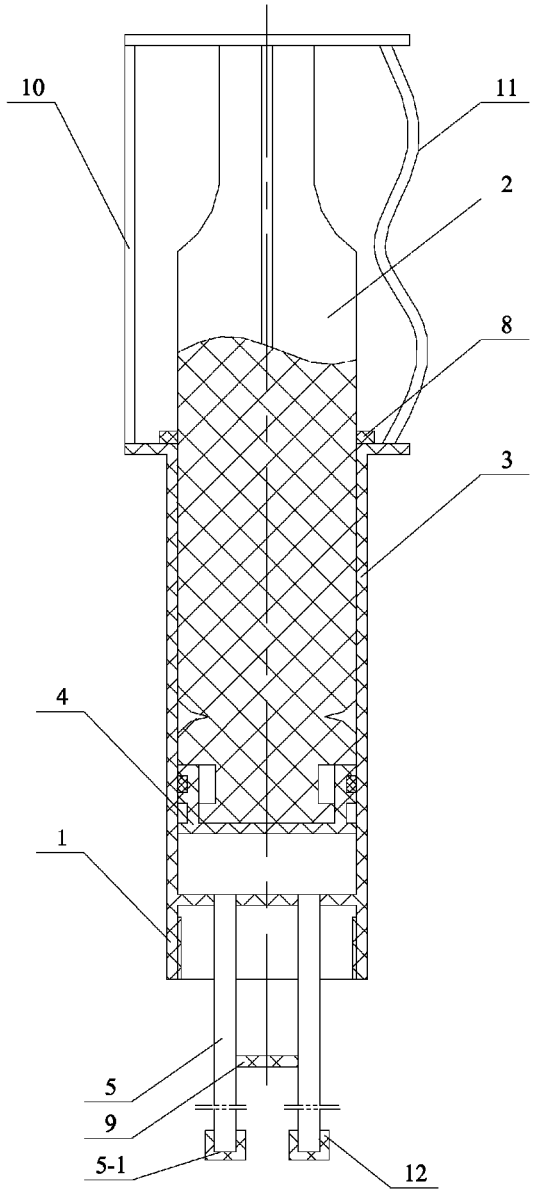
FIG. 3 is a schematic diagram of the entire structure of the invention (the suction pipe mouth 5-1 is a plane, spacing is formed between two adjacent suction pipes 5, the liquid suction cavity 3 and the bottle cap 1 are integrated, and the vacuum draw bar 2 is a straight bar)
Figure 4:
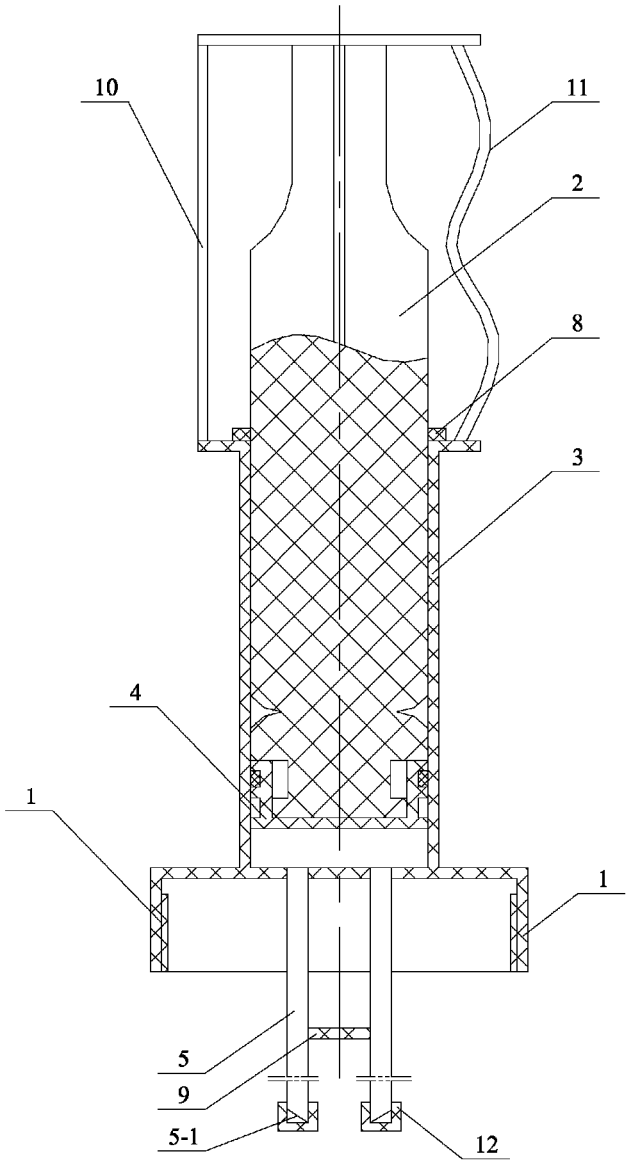
FIG. 4 is a schematic diagram of the entire structure of the invention (the suction pipe mouth 5-1 is a slope, spacing is formed between two adjacent suction pipes 5, the liquid suction cavity 3 and the bottle cap 1 are integrated, and the vacuum draw bar 2 is a straight bar)
Figure 5:
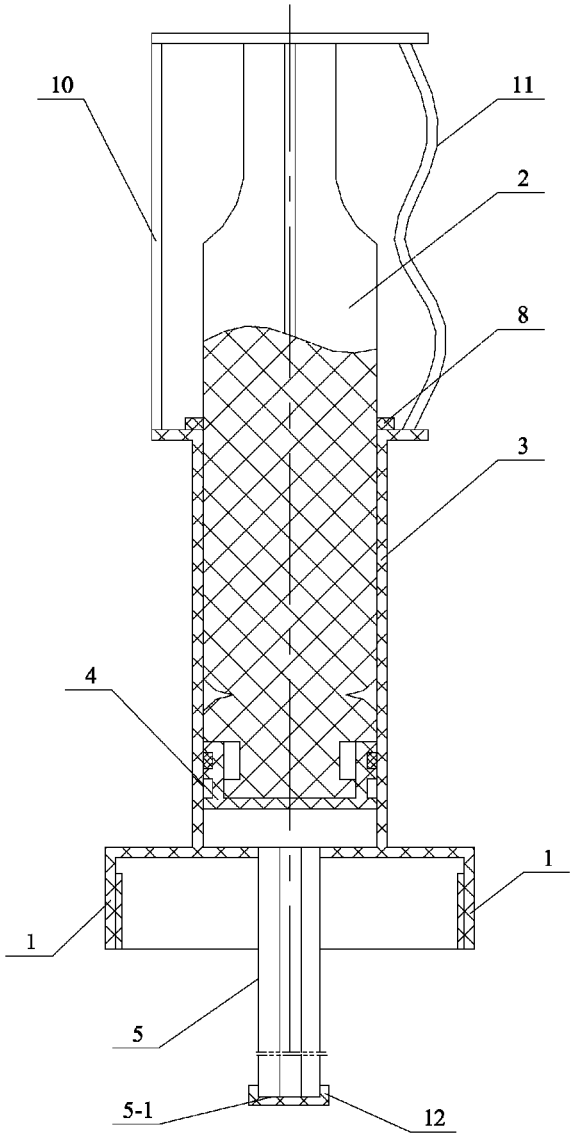
FIG. 5 is a schematic diagram of the entire structure of the invention (the suction pipe mouth 5-1 is a plane, the outer walls of two adjacent suction pipes 5 are adhered to each other, the liquid suction cavity 3 and the bottle cap 1 are integrated, and the vacuum draw bar 2 is a straight bar)

Description is made below to the embodiment with reference to FIGS. 1, 3 to 5, 7, 8, 9, 10, 11 and 12; the suction type bottle cap in the embodiment comprises a bottle cap 1, the sidewall of an inner cavity of the bottle cap 1 is provided with an internal thread connected with a bottle mouth; the suction type bottle cap further comprises a suction device; the suction device comprises a vacuum draw bar 2, a liquid suction cavity 3, a piston 4 and at least one suction pipe 5; the liquid suction cavity 3 is connected with the bottle cap 1, the upper end of the suction pipe 5 is communicated with the liquid suction cavity 3, the lower end of the vacuum draw bar 2 is mounted in the liquid suction cavity 3 and the lower end of the vacuum draw bar 2 is equipped with the piston 4.

The suction type bottle cap in the embodiment is better in practicability and is more suitable for popularization and application.

When the length of the suction pipe 5, which can be any length, is less than a half of the height of a bottle (or no more than 10 centimeters), the liquid at the lower part of the bottle can be sucked by the suction pipe even if the suction pipe is located at the upper part of the bottle. When in use, the liquid can be sucked only by the steps of sloping the bottle to cause the liquid to flow to the position near the bottle mouth and then stretching the suction pipe 5 to the position in the liquid mouth where the liquid exists. Preferably, in order to suck the liquid more conveniently, the suction pipe can be designed to be slantwise, curved or folded in relation to the bottle, thus the suction pipe mouth gets close to the bottle wall near the bottle mouth more easily. The liquid is sucked into the liquid suction cavity 3 by the suction pipe 5 and is then discharged to the required position by the suction pipe 5, the bottle cap 1 is replaced to the bottle mouth and the suction pipe 5 is placed in the bottle when the suction type bottle cap is not used, and the suction pipe 5 is placed in the bottle when not in use or after the use for the first time.

Embodiment 2

The difference of the embodiment from Embodiment 1 is that: the upper end of the suction pipe 5 penetrates through the bottle cap 1 to be communicated with the liquid suction cavity 3.

When the length of the suction pipe 5, which can be any length, is less than a half of the height of a bottle (or no more than 10 centimeters), the liquid at the lower part of the bottle can be sucked by the suction pipe even if the suction pipe is located at the upper part of the bottle. When in use, the liquid can be sucked only by the steps of sloping the bottle to cause the liquid to flow to the position near the bottle mouth and then stretching the suction pipe 5 to the position in the liquid mouth where the liquid exists. Preferably, in order to suck the liquid more conveniently, the suction pipe can be designed to be slantwise, curved or folded in relation to the bottle, thus the suction pipe mouth gets close to the bottle wall near the bottle mouth more easily. The liquid is sucked into the liquid suction cavity 3 by the suction pipe 5 and is then discharged to the required position by the suction pipe 5, the bottle cap 1 is replaced to the bottle mouth and the suction pipe 5 is placed in the bottle when the suction type bottle cap is not used, and the suction pipe 5 is placed in the bottle when not in use or after the use for the first time.

Embodiment 3

Description is made below to the embodiment with reference to FIGS. 1, 3 to 5, 7 and 8; the difference of the embodiment from Embodiment 2 or 3 is that: the liquid suction cavity 3 and the bottle cap 1 are integrated or split in two parts, the liquid suction cavity 3 and the bottle cap 1, which are split in two parts, are tightly connected with each other in the manner of a threaded fastener, and the integration of the liquid suction cavity 3 with the bottle cap 1 is convenient for processing.

Embodiment 4

Figure 6:
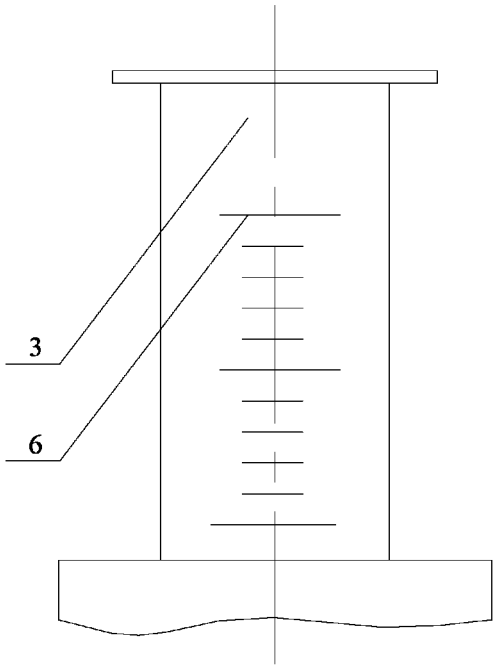
FIG. 6 is a schematic diagram of the external structure of the liquid suction cavity 3 (with the scale mark 6)
Figure 7:
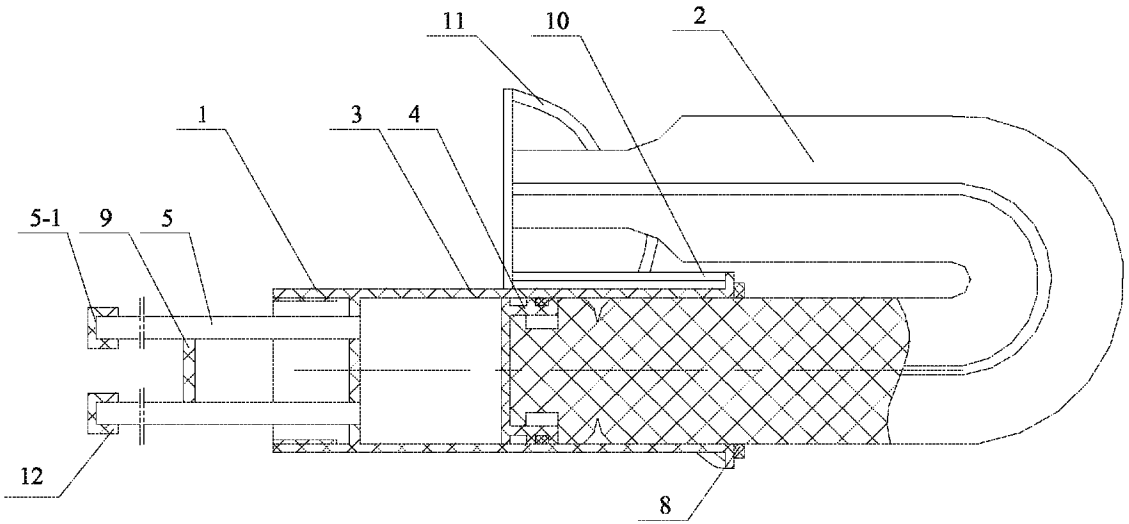
FIG. 7 is a schematic diagram of the entire structure of the invention (the suction pipe mouth 5-1 is a plane, spacing is formed between two adjacent suction pipes 5, the liquid suction cavity 3 and the bottle cap 1 are integrated, and the vacuum draw bar 2 is a straight bar)
Figure 8:
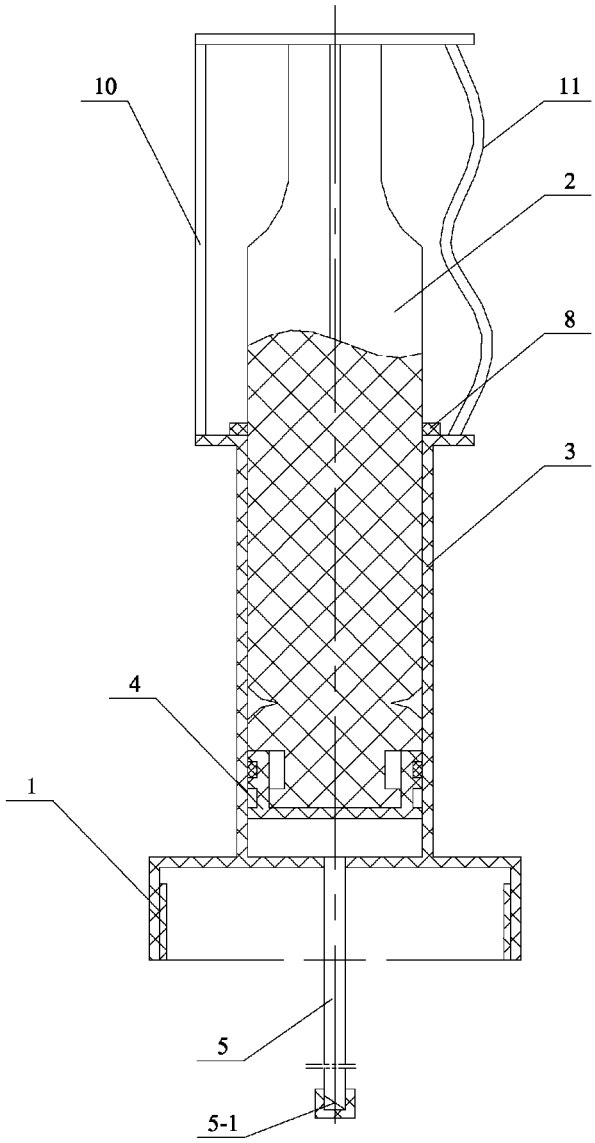
FIG. 8 is a schematic diagram of the entire structure of the invention (the suction pipe mouth 5-1 is a slope, one suction pipe 5 is adopted, the liquid suction cavity 3 and the bottle cap 1 are integrated, and the vacuum draw bar 2 is a straight bar)
Figure 9:
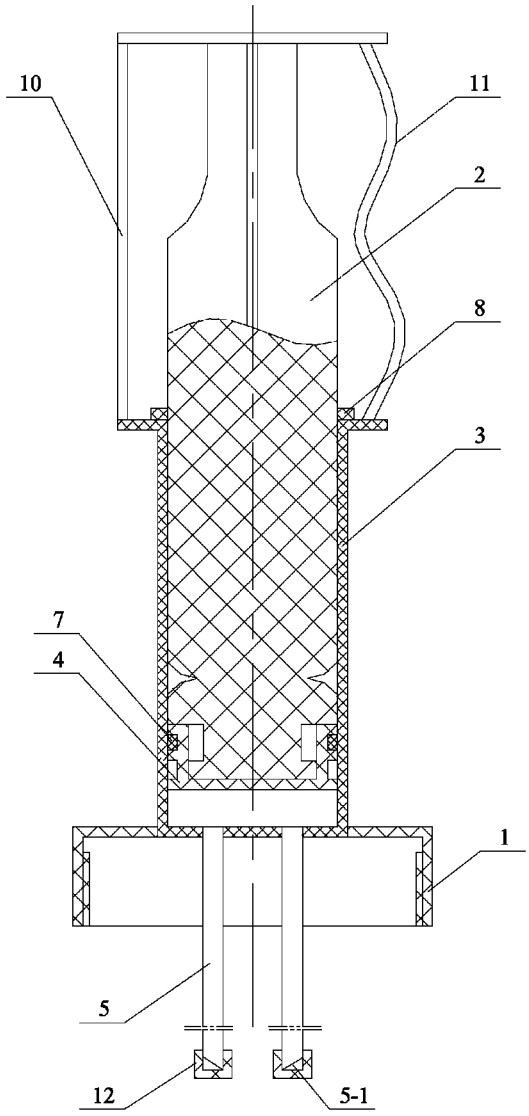
FIG. 9 is a schematic diagram of the entire structure of the invention (the lower end face of the liquid suction cavity 3 is in a line with the upper end face of the inner cavity of the bottle cap 1)
Figure 10:
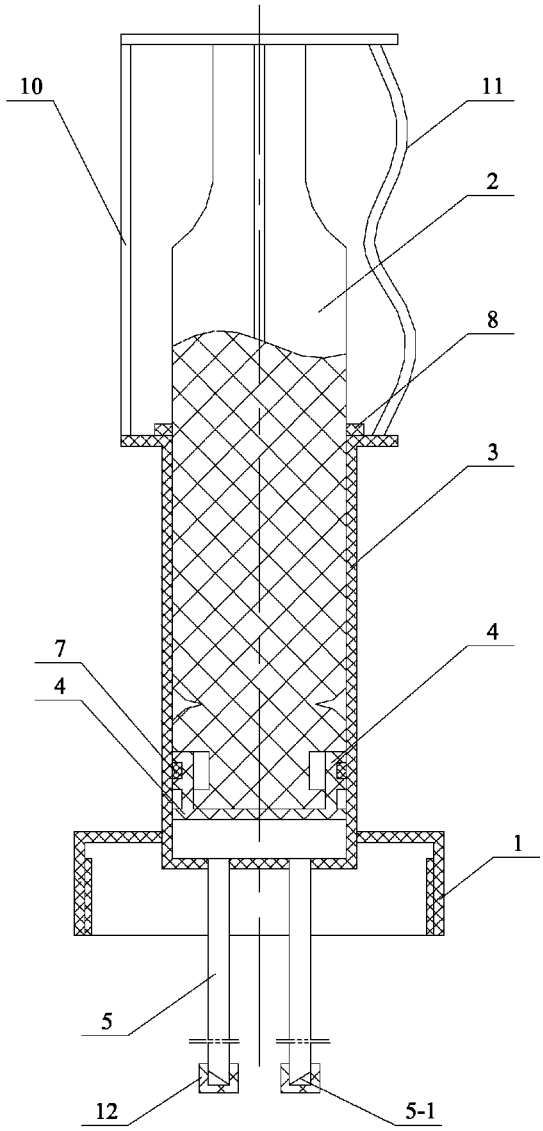
FIG. 10 is a schematic diagram of the entire structure of the invention (the lower end face of the liquid suction cavity 3 is arranged inside the inner cavity of the bottle cap 1)
Figure 11:
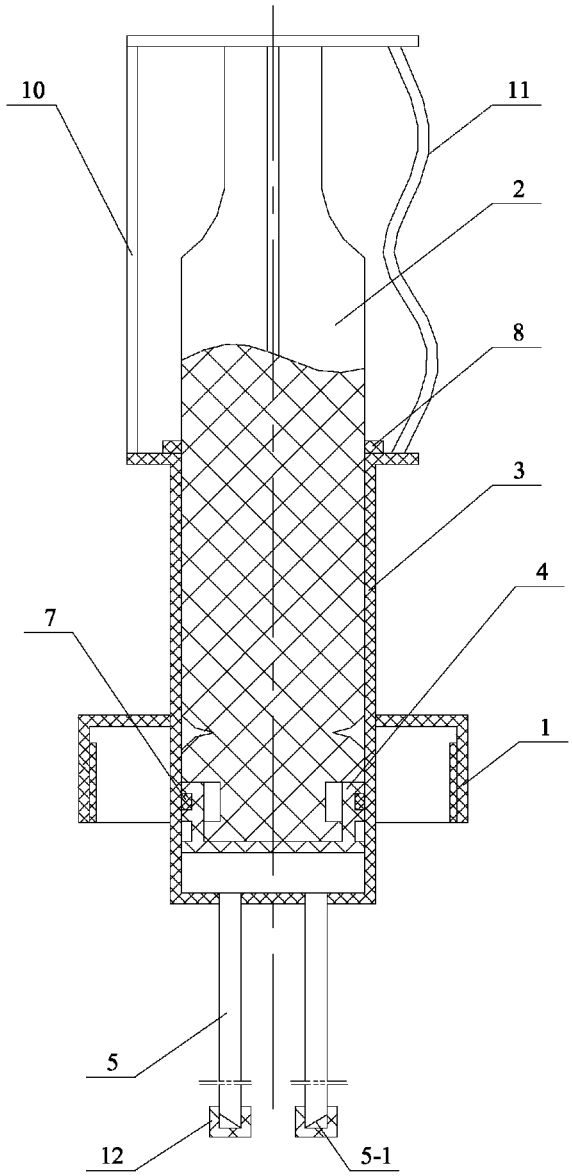
FIG. 11 is s a schematic diagram of the entire structure of the invention (the lower end face of the liquid suction cavity 3 penetrates through the inner cavity of the bottle cap 1 to be arranged outside the lower end face of the bottle cap 1)

Description is made below to the embodiment with reference to FIG. 6; the difference of the embodiment from Embodiment 1, 2 or 3 is that: the inner wall or the outer wall of the liquid suction cavity 3 is provided with the scale mark 6. And such an arrangement is convenient for the measurement for the sucked liquid.

Embodiment 5

Description is made below to the embodiment with reference to FIGS. 1 to 5, 7 and 8; the difference of the embodiment from Embodiment 1, 2, 3 or 4 is that: the vacuum draw bar 2 is a straight bar or a curved bar, and the cross section of the vacuum draw bar 2 is cross-shaped, X-shaped, round or square. The vacuum draw bar 2 is designed as the curved bar in order to facilitate the control of the thumb for the vacuum draw bar 2 to move vertically when the outer wall of the liquid suction cavity 3 is held by a hand. The round cross section is better suitable for the curved vacuum draw bar 2.

Embodiment 6

Description is made below to the embodiment with reference to FIGS. 1, 3 to 5, 7 and 8; the difference of the embodiment from Embodiment 1, 2, 3 or 4 is that: the number of the suction pipe 5 is 1 to 4, the suction pipe mouth 5-1 is a plane or a slope, and the suction pipe 5 can be designed to be straight, angled or curved. And with such an arrangement, faster suction and discharging can be obtained when a plurality of suction pipes 5, instead of one suction pipe 5, are adopted. When a plurality of suction pipes 5 are arranged, the suction pipes 5 may be arranged on the same plane as the suction pipe month 5-1, but should be arranged to form a slope with respect to the suction pipe month 5-1 as much as possible, so that, when the bottle body is sloped to suck the liquid, a plurality of suction pipe months come into parallel contact with the wall of the bottle and are all submerged in the liquid as much as possible, not in the air above the liquid, therefore, the possibility of air suction is reduced.

Embodiment 7

Description is made below to the embodiment with reference to FIGS. 1, 3 to 5, 7 and 8; the difference of the embodiment from Embodiment 1, 2, 3 or 4 is that: the number of the suction pipes 5 is 2 to 4, and the outer walls of the 2 to 4 suction pipes 5 are adhered to one another or spacing is formed between two adjacent suction pipes 5. Such a design in which the outer walls of a plurality of suction pipes 5 are adhered to one another is liable to converge the liquid at a position through a plurality of suction pipe mouths so as to cause unnecessary dropping; and because the unnecessary dropping caused by the convergence of the liquid at a position through a plurality of suction pipe mouths 5-1 is reduced, the design in which spacing is formed between two adjacent suction pipes 5 is superior to the previous design.

Embodiment 8

Description is made below to the embodiment with reference to FIGS. 1, 3 to 5, 7 and 8; the difference of the embodiment from Embodiment 8 is that: the suction device in the embodiment further comprises a support tie bar 9; and the two adjacent suction pipes 5 with spacing therebetween are connected with each other via the support tie bar 9. In order to reduce the possibility that the liquid flows out of the suction pipe mouths and avoid as much as possible that the liquid flowing out of a plurality of suction pipe mouths 5-1 converges in a spherical shape so as to keep the suction pipes 5 from one another at certain intervals, preferably, the support tie bar 9 is arranged at non-suction pipe mouths so that the suction pipes 5 are more firm and stable as well as hardly shake. When not in use, the suction pipe 5 is placed in the bottle so that the residual liquid in the suction pipe 5 contacting with the liquid can drop into the bottle after long-time dropping, instead of flowing somewhere else to cause pollution, and the waiting for the residual liquid at the bottle mouth to drop is not required.

Embodiment 9

Description is made below to the embodiment with reference to FIGS. 1, 3 to 5, 7 and 8; the difference of the embodiment from Embodiment 1, 2, 3 or 4 is that: the suction device further comprises a liquid suction cavity dustproof ring 8; the upper end face of the liquid suction cavity 3 is provided with the liquid suction cavity dustproof ring 8, and the liquid suction cavity dustproof ring 8 is in sliding fit with the vacuum draw bar 2. On the premise of guaranteeing ventilation, such an arrangement can prevent dust from entering into the liquid suction cavity 3, and simultaneously, has no impact on the reciprocating drawing of the vacuum draw bar 2. The vacuum draw bar 2 can be curved to be adhered to the outer wall of the liquid suction cavity 3.

Embodiment 10

Description is made below to the embodiment with reference to FIGS. 1, 3 to 5, 7 and 8; the difference of the embodiment from Embodiment 1, 2, 3 or 4 is that: the suction device further comprises a piston seal ring 7; the outer wall of the piston 4 is provided with an annular groove, the piston seal ring 7 is arranged in the annular groove of the piston 4, and the piston seal ring 7 is in sliding fit with the inner wall of the liquid suction cavity 3. Such an arrangement leads to better sealing effect.

Embodiment 11

Description is made below to the embodiment with reference to FIGS. 1, 3 to 5, 7 and 8; the difference of the embodiment from Embodiment 1, 2, 3 or 4 is that: the suction device further comprises an anti-pulling chain 10; and the liquid suction cavity 3 is connected with the handle end of the vacuum draw bar 2 via the anti-pulling chain 10. Such an arrangement can prevent erroneous movement or identify whether the product has been used or not (similar to the anti-twisting plastic chain on mineral water bottle cap). In order to draw the vacuum draw bar 2 conveniently, preferably, the distance as long as two fingers can be generated between the vacuum draw bar 2 and the liquid suction cavity 3.

Embodiment 12

Description is made below to the embodiment with reference to FIGS. 1, 3 to 5, 7 and 8; the difference of the embodiment from Embodiment 1, 2, 3 or 4 is that: the suction device further comprises a safety chain 11; the liquid suction cavity 3 is connected with the handle end of the vacuum draw bar 2 via the safety chain 11, and the length of the safety chain 11 is equal to the maximal travel of the vacuum draw bar 2. One safety chain 11 is arranged between the vacuum draw bar 2 and the liquid suction cavity 3 in order to prevent the pollution caused by the contact between the vacuum draw bar 2 and the liquid suction cavity 3 after the hand comes into contact with the vacuum draw bar 2 in the using process. When being drawn beyond a safety distance, the safety chain 11 reaches the longest state and cannot be drawn any more, thus the pollution caused by the contact between the vacuum draw bar 2 and the liquid suction cavity 3 after the hand comes into contact with the vacuum draw bar 2 in the using process can be prevented.

Embodiment 13

Description is made below to the embodiment with reference to FIGS. 1, 3 to 5, 7 and 8; the difference of the embodiment from Embodiment 1, 2, 3 or 4 is that: the suction device further comprises a blocking cap 12; and the suction pipe mouth 5-1 is equipped with the blocking cap 12. During the usage of a user, the blocking cap 12 is removed so that the liquid is not liable to flow from the suction pipe mouth 5-1 into the liquid suction cavity 3 and the user can know that this product has not been used. One end of the suction pipe mouth 5-1 can also be closed off, and the liquid can be sucked only by using a scissor to cut off one section during the usage of the user.

Embodiment 14

Figure 12:
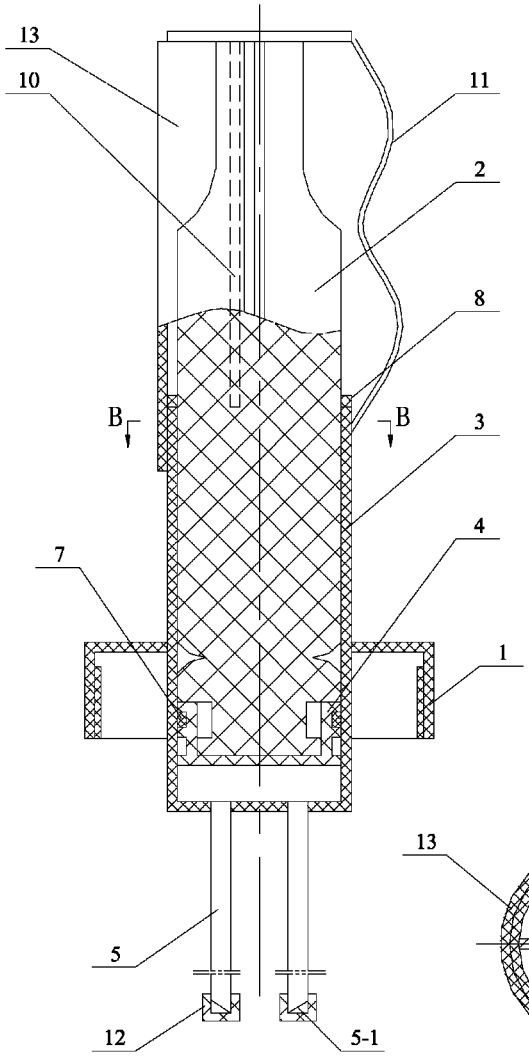
FIG. 12 is a schematic diagram of the structure of the embodiment 14.
Figure 13:
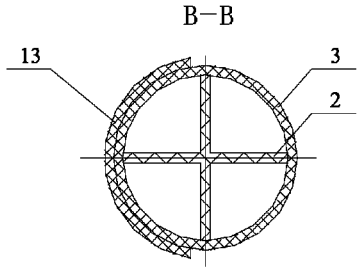
FIG. 13 is a B-B sectional view of FIG. 12.

Description is made below to the embodiment with reference to FIGS. 12 and 13; the difference of the embodiment from Embodiment 1, 2, 3 or 4 is that: the suction type bottle cap further comprises a circular arc pushing plate 13, the upper end of the circular arc pushing plate 13 is fixedly connected with the upper end of the vacuum draw bar 2, and an inner concave face of the circular arc pushing plate 13 is adhered to and is in sliding fit with the outer wall of the liquid suction cavity 3.

Embodiment 15

The difference of the embodiment from Embodiment 1, 2, 3 or 4 is that: the distance from the suction pipe mouth 5-1 of the suction pipe 5 to the inner bottom surface of the bottle is one third to fourteen fifteenth the vertical length from the top of the bottle mouth to the inner bottom of the bottle.

Embodiment 16

The difference of the embodiment from Embodiment 1, 2, 3 or 4 is that: the distance from the suction pipe mouth 5-1 of the suction pipe 5 to the inner bottom surface of the bottle is one half to fourteen fifteenth the vertical length from the top of the bottle mouth to the inner bottom of the bottle.

Embodiment 17

The difference of the embodiment from Embodiment 1, 2, 3 or 4 is that: the distance from the suction pipe mouth 5-1 of the suction pipe 5 to the inner bottom surface of the bottle is two third to fourteen fifteenth the vertical length from the top of the bottle mouth to the inner bottom of the bottle.

The embodiments described above contribute merely to understanding the core concept of the invention; meanwhile, modifications in the aspect of the embodiments and the applicable scope shall be made by the ordinary skilled in this art without departing from the concept of the invention. In sum, the content of the invention shall not be considered as the limitation to the invention.

When a bottle having the suction type bottle cap of the invention is used, the bottle is held by one hand and the bottle cap 1 is twisted by the other hand (under the situation of rotary fastening), after the twisting, the liquid can be sucked into the liquid suction cavity 3 only by pushing the circular arc pushing plate 13, the liquid is then discharged from the liquid suction cavity 3 to a required position, afterwards, the bottle cap is replaced and then restored by twisting (primary liquid acquisition ends), and the bottle cap 1 can be operated by one hand.

Not limited by the embodiments described above, the structure of the suction type bottle cap of the invention for preventing liquid from polluting bottle mouth and being wasted and conveniently measuring may be any reasonable combination of the technical features recorded in the embodiments described above.

What is claimed is:

1. A suction bottle cap for preventing liquid from polluting bottle mouth and being wasted and conveniently measuring, the suction bottle cap comprising a bottle cap and the sidewall of an inner cavity of the bottle cap being provided with an internal thread connectable with a bottle mouth; the suction bottle cap further comprises a suction device; the suction device comprises a vacuum draw bar, a liquid suction cavity, a piston and at least one suction pipe; the liquid suction cavity is connected with the bottle cap, the upper end of the suction pipe penetrates through the bottle cap to be communicated with the liquid suction cavity, the lower end of the vacuum draw bar is mounted in the liquid suction cavity and the lower end of the vacuum draw bar is equipped with the piston.

2. The suction bottle cap for preventing liquid from polluting bottle mouth and being wasted and conveniently measuring according to claim 1, characterized in that the inner wall or the outer wall of the liquid suction cavity is provided with a scale mark.

3. The suction bottle cap for preventing liquid from polluting bottle mouth and being wasted and conveniently measuring according to claim 1, characterized in that the number of the suction pipes is 2 to 4, and the outer walls of the 2 to 4 suction pipes are adhered to one another or spacing is formed between two adjacent suction pipes.

4. The suction bottle cap for preventing liquid from polluting bottle mouth and being wasted and conveniently measuring according to claim 3, characterized in that the suction device further comprises a support tie bar; and the two adjacent suction pipes with spacing therebetween are connected with each other via the support tie bar.

5. The suction bottle cap for preventing liquid from polluting bottle mouth and being wasted and conveniently measuring according to claim 1, characterized in that the suction device further comprises a liquid suction cavity dustproof ring; the upper end face of the liquid suction cavity is provided with the liquid suction cavity dustproof ring, and the liquid suction cavity dustproof ring is in sliding fit with the vacuum draw bar.

6. The suction bottle cap for preventing liquid from polluting bottle mouth and being wasted and conveniently measuring according to claim 1, characterized in that the suction device further comprises a piston seal ring; the outer wall of the piston is provided with an annular groove, the piston seal ring is arranged in the annular groove of the piston, and the piston seal ring is in sliding fit with the inner wall of the liquid suction cavity.

7. The suction bottle cap for preventing liquid from polluting bottle mouth and being wasted and conveniently measuring according to claim 1, characterized in that the suction device further comprises an anti-pulling chain; and the liquid suction cavity is connected with the handle end of the vacuum draw bar via the anti-pulling chain.

8. The suction bottle cap for preventing liquid from polluting bottle mouth and being wasted and conveniently measuring according to claim 1, characterized in that the suction device further comprises a safety chain; the liquid suction cavity is connected with the handle end of the vacuum draw bar via the safety chain, and the length of the safety chain is equal to the maximal travel of the vacuum draw bar.

9. The suction bottle cap for preventing liquid from polluting bottle mouth and being wasted and conveniently measuring according to claim 1, characterized in that the suction device further comprises a blocking cap; and the suction pipe mouth is equipped with the blocking cap.

10. The suction bottle cap for preventing liquid from polluting bottle mouth and being wasted and conveniently measuring according to claim 1, characterized in that the suction bottle cap further comprises a circular arc pushing plate, the upper end of the circular arc pushing plate is fixedly connected with the upper end of the vacuum draw bar, and an inner concave face of the circular arc pushing plate is adhered to and is in sliding fit with the outer wall of the liquid suction cavity.

11. The suction bottle cap for preventing liquid from polluting bottle mouth and being wasted and conveniently measuring according to claim 1, characterized in that the distance from the suction pipe mouth of the suction pipe to the inner bottom surface of the bottle is one third to fourteen fifteenth the vertical length from the top of the bottle mouth to the inner bottom of the bottle.

12. The suction bottle cap for preventing liquid from polluting bottle mouth and being wasted and conveniently measuring according to claim 1, characterized in that the distance from the suction pipe mouth of the suction pipe to the inner bottom surface of the bottle is one half to fourteen fifteenth the vertical length from the top of the bottle mouth to the inner bottom of the bottle.

13. The suction bottle cap for preventing liquid from polluting bottle mouth and being wasted and conveniently measuring according to claim 1, characterized in that the distance from the suction pipe mouth of the suction pipe to the inner bottom surface of the bottle is two third to fourteen fifteenth the vertical length from the top of the bottle mouth to the inner bottom of the bottle.

14. The suction bottle cap for preventing liquid from polluting bottle mouth and being wasted and conveniently measuring according to claim 1, characterized in that the bottle cap is below the liquid suction cavity when the suction bottle cap is upright.

15. The suction bottle cap for preventing liquid from polluting bottle mouth and being wasted and conveniently measuring according to claim 2, characterized in that the bottle cap is below the scale bar when the suction bottle cap is upright.

16. The suction bottle cap for preventing liquid from polluting bottle mouth and being wasted and conveniently measuring according to claim 1, characterized in that the bottle cap and the liquid suction cavity are configured to be integrated or split in two parts; the bottle cap and the liquid suction cavity, when split in two parts, are connected with each other in a manner of a threaded fastener.

17. The suction bottle cap for preventing liquid from polluting bottle mouth and being wasted and conveniently measuring according to claim 1, characterized in that the vacuum draw bar is a straight bar or a curved bar, and a cross section of the vacuum bar is cross-shaped, X-shaped, round or square.

18. The suction bottle cap for preventing liquid from polluting bottle mouth and being wasted and conveniently measuring according to claim 1, characterized in that the number of the suction pipe is 1 to 4, and the suction pipe mouth is a plane or a slope, and the suction pipe is straight, angled or curved.

19. The suction bottle cap for preventing liquid from polluting bottle mouth and being wasted and conveniently measuring according to claim 1, characterized in that a length of the suction pipe is less than a half of a height of a bottle, or no more than 10 centimeters.

* * * * *